US008757712B2

(12) United States Patent
Wiecek

(10) Patent No.: US 8,757,712 B2
(45) Date of Patent: Jun. 24, 2014

(54) FULL-FLAT RECLINE LINKAGE

(71) Applicant: L & P Property Mangement Company, South Gate, CA (US)

(72) Inventor: Glenn N. Wiecek, Bradenton, FL (US)

(73) Assignee: L & P Property Management Company, South Gate, CA (US)

( * ) Notice: Subject to any disclaimer, the term of this patent is extended or adjusted under 35 U.S.C. 154(b) by 0 days.

(21) Appl. No.: 13/903,645

(22) Filed: May 28, 2013

(65) Prior Publication Data

US 2013/0257111 A1 Oct. 3, 2013

Related U.S. Application Data

(63) Continuation of application No. 12/729,819, filed on Mar. 23, 2010, now Pat. No. 8,449,027.

(51) Int. Cl.
*A47C 1/02* (2006.01)

(52) U.S. Cl.
USPC ..... 297/84; 297/75

(58) Field of Classification Search
USPC ..... 297/83, 84, 85, 86, 75, 270.1, 270.2, 297/270.5
See application file for complete search history.

(56) References Cited

U.S. PATENT DOCUMENTS

| | | | | |
|---|---|---|---|---|
| 3,163,464 | A * | 12/1964 | Martin et al. | 297/85 R |
| 3,815,954 | A | 6/1974 | Rogers et al. | |
| 7,497,512 | B2 * | 3/2009 | White et al. | 297/85 R |
| 2005/0067867 | A1 | 3/2005 | May | |

OTHER PUBLICATIONS

Extended European Search Report for PCT/US2011029211, mailed Feb. 7, 2014.

* cited by examiner

*Primary Examiner* — Sarah B McPartlin
(74) *Attorney, Agent, or Firm* — Shook Hardy & Bacon LLP

(57) ABSTRACT

A linkage that provides a fully flat reclined position is described. The linkage includes a full-flat lift link pivotally coupled to a seat support link. A backrest support link couples to the lift link through an oblong aperture to provide additional range of motion. The lift link includes a laterally extending flange, the perimeter of which acts as a cam surface for a cam pin that obstructs reclining of the backrest support link when the rocker-recliner is in an upright position. When fully reclined, the linkage configures a footrest, seat portion, and backrest portion in a generally equal plane to provide a fully flat seating surface.

19 Claims, 3 Drawing Sheets

FULL-FLAT RECLINE LINKAGE

CROSS-REFERENCE TO RELATED CASE

This application is a continuation of U.S. Ser. No. 12/729,819 (to be issued as U.S. Pat. No. 8,449,027), which was filed on Mar. 23, 2010.

BACKGROUND

Recliner and rocker-recliner chairs are generally well known in the furniture industry. The terms recliner and rocker-recliner are used throughout this discussion to describe articles of furniture that include a reclining mechanism, either with or without a rocking feature. Generally rocker-recliners are chairs that allow the user to rock as well as recline and are equipped with extendable footrests. Rocker-recliners are often in the form of a plush chair, however, they might also take the form of an oversized seat, a seat-and-a-half, a love seat, a sofa, a sectional, and the like.

The rocker mechanism is generally well known in the furniture industry. The rocker mechanism typically has a base that includes a pair of side rails that are interconnected with a pair of cross rails. The rocker mechanism also includes a rocker cam assembly and a spring assembly. The rocker cam assembly is coupled to the top surface of the side rails. The rocker cams are typically made from wood, plastic, or metal and have a curved cam surface that contacts an upper surface of the side rails. The curved cam surface allows the rocking motion of the chair. Spring retention devices are coupled to cross rails with a set of springs mounted therebetween. The springs resist the rocking motion of the chair and bias the chair to a neutral at rest position.

The reclining motion is achieved in rocker-recliner chairs with a linkage mechanism that is coupled to the base and/or a rocker mechanism. The linkage mechanisms found in rocker-recliner chairs in the art include a plurality of interconnected links that provide one or more mechanisms for extending a footrest, reclining the chair, and obstructing movements of the chair when in specific orientations. Typically, rocker-recliners known in the art provide three positions: an upright seated position with the footrest retracted beneath the chair, a television viewing or TV position in which the chair back is slightly reclined but still provides a generally upright position with the footrest extended, and a "full" recline position in which the chair back is reclined an additional amount further than in the TV position but still generally inclined with respect to the seat of the chair and with the foot rest extended.

This type of prior art recliner mechanism, while functional, suffers from a number of drawbacks. One of which includes the inability to provide a fully flat seating surface when in the full reclined position. Many prior art designs achieve only about a 30° angle (with respect to the horizontal) of a backrest portion of the recliner. Further, such is only achieved through the extension of a footrest to a height well above the height of a seat portion of the recliner. These designs also typically incline and lower the seat portion of the recliner as it moves to its fully reclined position. As such, occupants are placed in a generally V-shaped reclined position with their feet and head at heights above their hips. Thus, occupants of prior art rocker-recliners are restricted to lying on their back in a partially upright seated position. Such users are unable to lie fully flat on their back and are unable to comfortably lie on their side or front in common sleeping positions.

SUMMARY

Embodiments of the invention are defined by the claims below, not this summary. A high-level overview of various aspects of the invention are provided here for that reason, to provide an overview of the disclosure, and to introduce a selection of concepts that are further described below in the detailed-description section. This summary is not intended to identify key features or essential features of the claimed subject matter, nor is it intended to be used as an aid in isolation to determine the scope of the claimed subject matter.

In an embodiment of the invention a linkage for use in reclining furniture is described. The linkage includes a seat support linkage that supports the seat portion of an article of furniture such as a rocker-recliner. The seat support linkage is coupled to a backrest support linkage and may also be coupled to a blocker linkage and an ottoman linkage. The seat support linkage includes a full-flat lift link that is pivotally coupled to a seat support link. The full-flat lift link is also rotatably coupled to a pivot link at a forward end and to a backrest support link at a rear end. The full-flat lift link includes a laterally extending flange with a generally annular perimeter that protrudes from a side portion of the full-flat lift link near the forward end.

The laterally extending flange of the full-flat lift link interacts with a cam pin on a main connecting link to resist extension of the ottoman linkage (if one is employed) and reclining of the backrest linkage when the rocker-recliner is in an upright position. When actuated from the upright position, the cam pin translates along the perimeter of the laterally extending flange of the full-flat lift link to enable extension of the ottoman linkage and reclining of the backrest linkage. The full-flat lift link also rotates about the pivot point with the seat support link to move the forward end thereof downwardly and the rear end upwardly. The configuration of the full-flat lift link provides added range of motion to the backrest linkage, thereby reclining the backrest and raising a seat portion a sufficient distance to provide a fully, or nearly fully flat seating surface. Additionally, in embodiments that employ the ottoman linkage and a footrest, the backrest and the seat portion are provided at an equal or nearly equal height to the extended footrest when in the fully, or nearly fully flat seating position.

DESCRIPTION OF THE DRAWINGS

Illustrative embodiments of the invention are described in detail below with reference to the attached drawing figures, and wherein.

DETAILED DESCRIPTION

Figure 2:
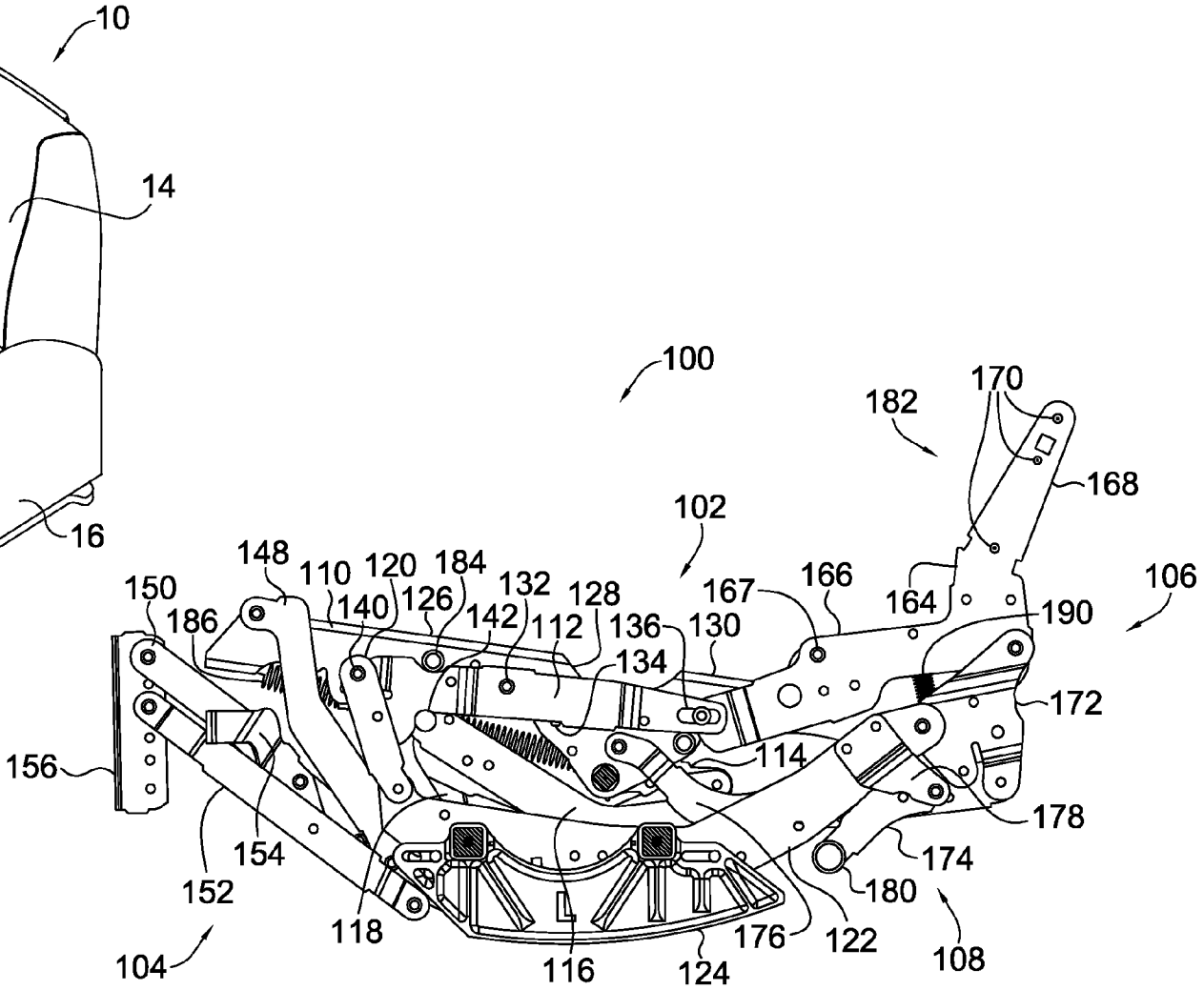
FIG. 2 is a left-side elevational view of a full-flat layout recliner mechanism in an upright position in accordance with an embodiment of the invention.

The subject matter of embodiments of the invention is described with specificity herein to meet statutory requirements. But the description itself is not intended to necessarily limit the scope of claims. Rather, the claimed subject matter might be embodied in other ways to include different steps, components, or combinations thereof, in conjunction with other present or future technologies. Terms should not be interpreted as implying any particular order among or between various steps herein disclosed unless and except when the order of individual steps is explicitly described.

In one embodiment of the invention a linkage for use in reclining furniture is described. The linkage includes a seat support linkage, an ottoman linkage, and a backrest linkage. The seat support linkage includes a seat support link, a connecting link having a cam pin disposed proximate a forward end, and a full-flat lift link rotatably coupled to the seat support link at a pivot point located between a first end and a second end of the full-flat lift link. The first end of the full-flat lift link includes a laterally extending flange that provides a cam surface for engaging the cam pin and the second end includes an elongated aperture for coupling to the backrest support link. The ottoman linkage is pivotally coupled to the seat support linkage. The backrest linkage includes the backrest support link coupled to the second end of the full-flat lift link. The linkage is disposed within an article of furniture having a seat portion that is at least partially supported by the seat support link and a backrest portion that is at least partially supported by the backrest support link. The pivot point of the full-flat lift link is positioned such that downward rotation of the first end of the full-flat lift link causes the backrest support link of the backrest linkage to rotate rearwardly a sufficient amount to produce a nearly flat seating surface formed by the seat portion and the backrest portion of the article of furniture.

In another embodiment, a three-position reclining chair configurable to a full-flat recline position via a linkage disposed therein is described. The linkage includes a seat support linkage that includes a seat support link, a connecting link having a cam pin disposed proximate a forward end, and a full-flat lift link rotatably coupled to the seat support link at a pivot point located between a first end and a second end of the full-flat lift link, the first end including a laterally extending flange that provides a cam surface for engaging the cam pin and the second end including an elongated aperture for coupling to a backrest support link. The linkage also includes an ottoman linkage pivotally coupled to the seat support linkage that extends a footrest from a front portion of the chair when the chair is moved from an upright position. A backrest linkage including the backrest support link is coupled to the second end of the full-flat lift link. The chair further includes a seat portion at least partially supported by the seat support link and a backrest portion at least partially supported by the backrest support link. The pivot point of the full-flat lift link is positioned such that downward rotation of the first end of the full-flat lift link causes the backrest support link of the backrest linkage to rotate rearwardly a sufficient amount to configure the chair in a full-flat recline position having a nearly flat seating surface formed by the seat portion, the backrest portion, and the extended footrest.

In another embodiment, a rocker-recliner chair that is configurable to a full-flat recline position via a linkage disposed therein is described. The linkage includes a seat support linkage that includes a seat support link and a full-flat lift link rotatably coupled to the seat support link at a pivot point located between a first end and a second end of the full-flat lift link. The first end includes a laterally extending flange and the second end includes an elongated aperture for coupling to a backrest support link. The linkage also includes a backrest linkage with the backrest support link coupled to the second end of the full-flat lift link and a blocker linkage that pivots downwardly from the backrest linkage to obstruct rocking motion of the chair when the chair is not in an upright position. The chair further includes a seat portion at least partially supported by the seat support link and a backrest portion at least partially supported by the backrest support link. The pivot point of the full-flat lift link is positioned such that downward rotation of the first end of the full-flat lift link rotates the backrest support link of the backrest linkage rearwardly and causes at least a portion of the seat support link to be raised a sufficient amount to configure the chair in a full-flat recline position having a nearly flat seating surface formed by the seat portion and the backrest portion.

Figure 1:
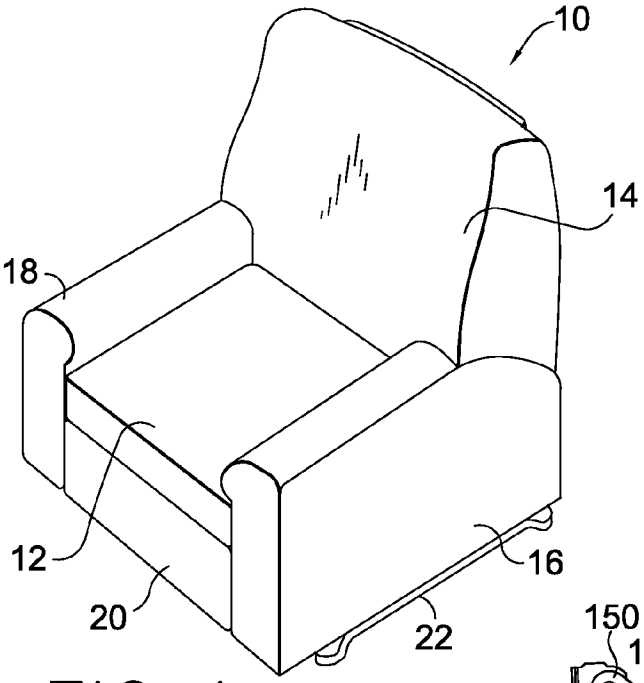
FIG. 1 is a perspective view of an exemplary rocker-recliner chair in an upright position in accordance with an embodiment of the invention.

Referring to the drawings and initially to FIG. 1, a rocker-recliner 10 is shown in an upright position in accordance with an embodiment of the invention. The rocker-recliner 10 broadly includes a seat portion 12, a backrest portion 14, a pair of side panels 16, 18, a footrest 20, and a base 22. Embodiments of the invention are discussed herein with respect to a rocker-recliner 10 however, such is not intended to limit embodiments of the invention to rocker-recliners only. Embodiments of the invention can be employed in various articles of furniture as discussed above and as will be understood by those of skill in the art.

Figure 3:
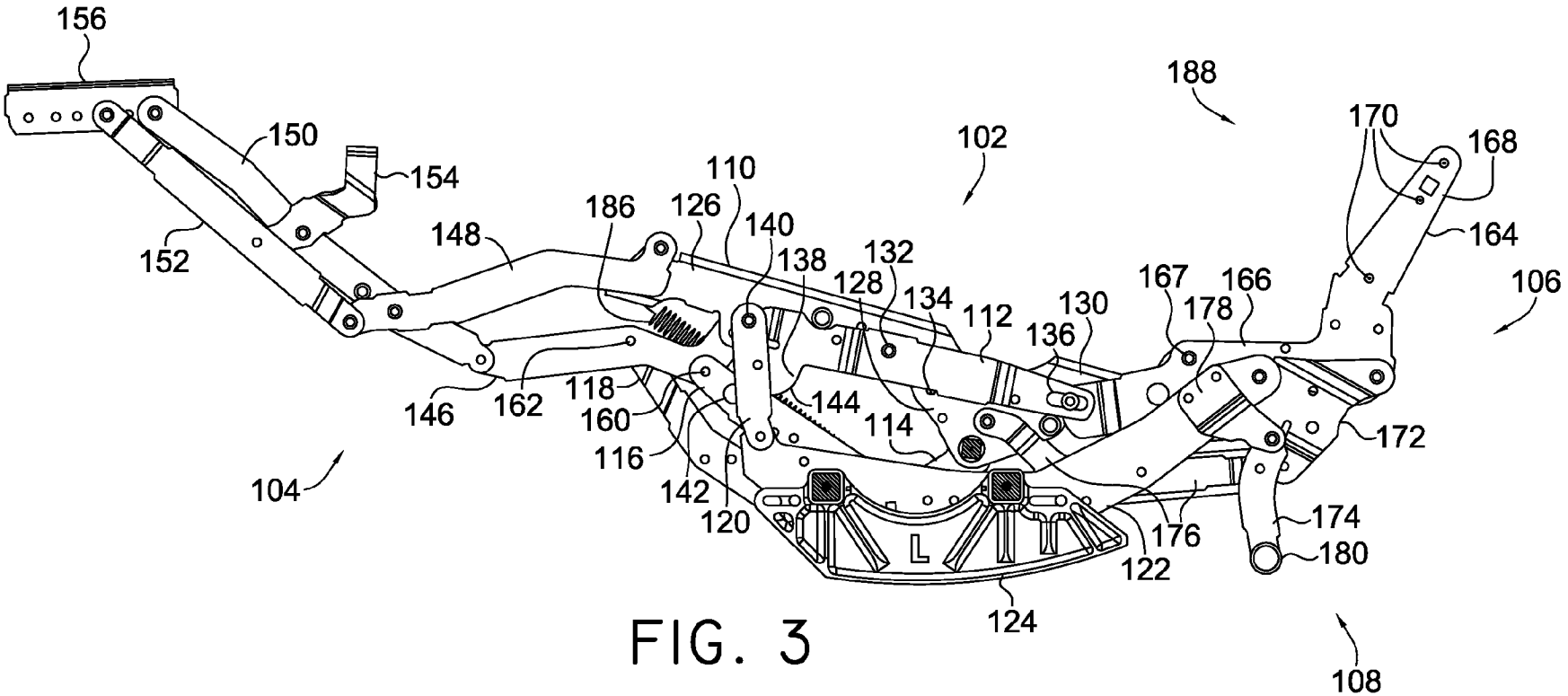
FIG. 3 is a left-side elevational view of a full-flat layout recliner mechanism in a reclined position in accordance with an embodiment of the invention.
Figure 4:
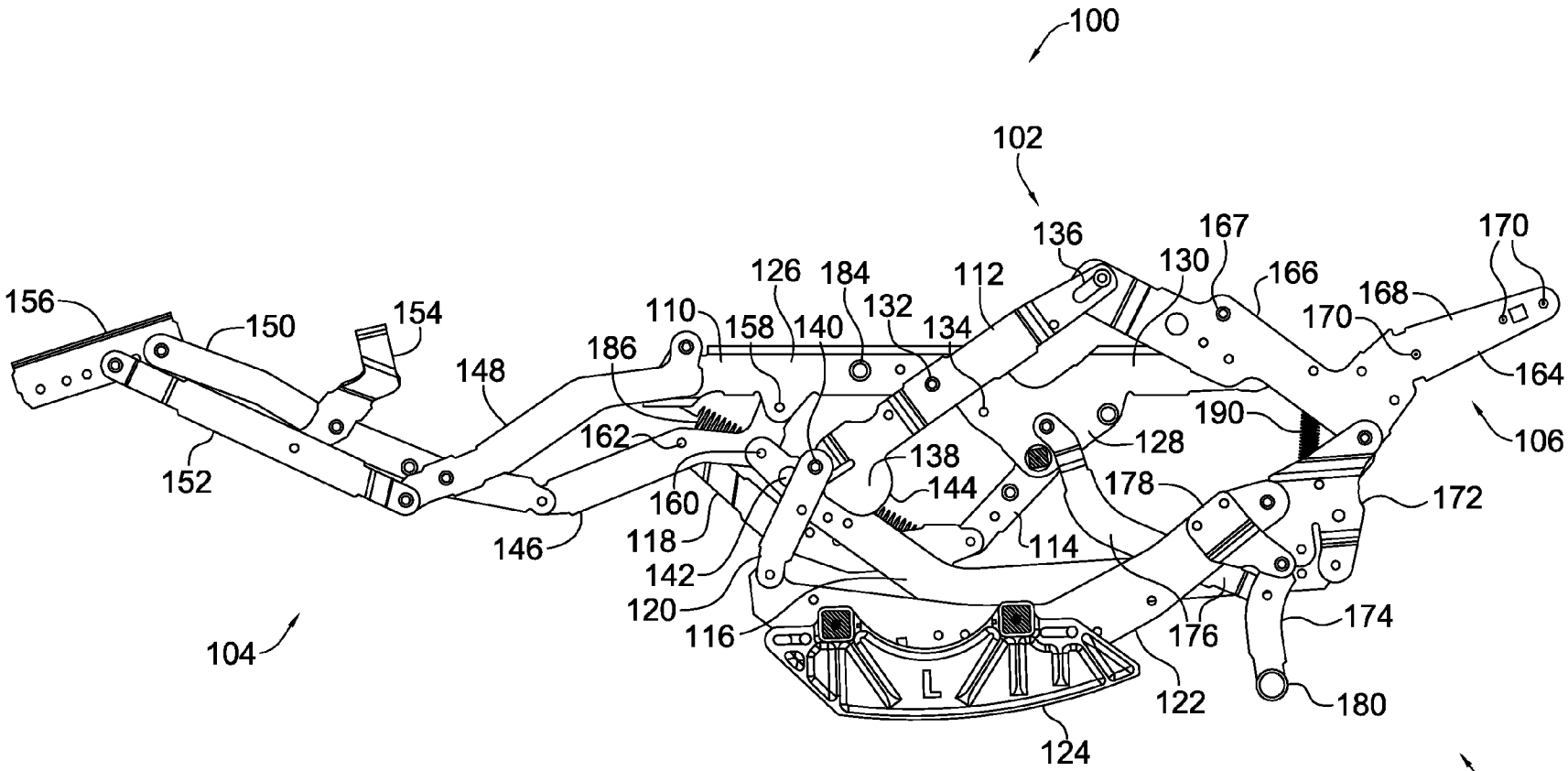
FIG. 4 is a left-side elevational view of a full-flat layout recliner mechanism in a full-flat layout position in accordance with an embodiment of the invention.

A mechanism 100 is depicted in FIGS. 2-4. The mechanism 100 is disposed within the rocker-recliner 10 to provide rocking and reclining movements thereto. The seat portion 12, backrest portion 14, side panels 16, 18, footrest 20, and base 22 are not depicted in FIGS. 2-4 for clarity however, one of skill in the art will recognize that such components are assembled to the mechanism 100 to provide the rocker-recliner chair 10.

In an embodiment, the mechanism 100 broadly includes a seat support linkage 102, an ottoman linkage 104, a backrest linkage 106, and a blocker linkage 108. The mechanism 100 also includes the base 22 (not shown in FIGS. 2-4) and may include a rocking mechanism (not shown) coupled to the seat support linkage 102. The rocking mechanism can include one or more springs, spring retaining members, and cross-members, among various other components that allow the rocker-recliner 10 to rock and provide a bias to resist rocking and return the rocker-recliner 10 to an upright, neutral position.

The mechanism 100 is described herein with respect to the left side elevational views depicted in FIGS. 2-4, in which FIG. 2 depicts the mechanism 100 in an upright position, FIG. 3 depicts a reclined or TV position, and FIG. 4 depicts a full-flat reclined position. It is understood that the right side of the rocker-recliner 10 includes a similarly configured, or mirror image mechanism 100 disposed in the right side of the rocker-recliner 10 and coupled to the left side mechanism 100 by one or more cross members or other similar components. Further, as depicted in FIGS. 2-4 reference is made herein to the forward and rear regions of the mechanism 100 and rocker-recliner 10. The term forward is used in reference to the front of the rocker-recliner (e.g., the side from which a footrest would extend and depicted to the left side of FIGS. 2-4) and the term rear is used in reference to the back side of the rocker-recliner 10 (e.g., the side that includes the backrest portion 14 and depicted to the right side of FIGS. 2-4).

With continued reference to FIGS. 2-4, the components of the mechanism 100 are described. The components of the mechanism 100 include generally planar links, brackets, and the like as well as pins coupling the various links together and springs for assisting movements of the mechanism 100. The links generally comprise sections of sheet steel that are die cut, stamped, machined, or otherwise formed into the desired configurations however, the links may be constructed from any desired materials and any desired manufacturing method may be utilized in their production. Further, the links are generally planar but may have one or more bends formed therein to provide various features in one or more additional planes.

The pins employed to couple one or more of the links together may include any form of pin available in the art such as for example, and not limitation, rivets, bolts, lugs, and the like. Additionally, the pins and apertures into which the pins are disposed might also include one or more friction reducing components such as for example, and not limitation, nylon washers, bushings, bearings, and the like or the pins may simply be lubricated by one or more greases, oils, or other lubricants.

It is also to be noted that although the components of the mechanism 100 are depicted as overlapping one another in FIGS. 2-4, such is not intended to limit the configuration of the components that is useable in embodiments of the invention. It is understood that the components may be assembled in various ways without departing from the scope of the invention disclosed herein.

The seat support linkage 102 includes a seat support link 110, a full-flat lift link 112, a toggle link 114, a main connecting link 116, an ottoman connecting link 118, a pivot link 120, a base link 122, and a rocker cam 124. The seat support linkage 102 provides support for the seat portion 12 of the rocker-recliner 10 and operably connects the various linkages 104-108 together. The seat support linkage 102 also connects the mechanism 100 to any rocking mechanism (not shown) employed in the rocker-recliner 10 and to the base 22 that supports the rocker-recliner 10 on a floor surface.

The seat support link 110 may comprise a generally planar element or may extend across the width of the rocker-recliner 10 to connect to the mechanism 100 on the opposite side of the rocker-recliner 10 as well as to provide a support platform for the seat portion 12 of the rocker recliner 10. The seat support link 110 extends nearly the full distance from the forward end to the rear end of the rocker-recliner 10 and couples to the ottoman linkage 104, the full-flat lift link 112, the backrest linkage 106, and the blocker linkage 108. The seat support link 110 includes a forward linear section 126, a downward arcing central section 128, and a linear rear section 130 that is generally aligned with the forward linear section 126.

The full-flat lift link 112 is pivotally coupled to the seat support link 110 at a pivot point 132. In an embodiment, movement of the location of the pivot point 132 between the full-flat lift link 112 and the seat support link 110 from a pivot point 134 to the pivot point 132 provides additional range of motion to the full-flat lift link 112 for further reclining the backrest linkage 106. The full-flat lift link 112 also includes an oblong aperture 136 at a rear end and a laterally extending flange 138 at a forward end thereof. The oblong aperture 136 provides a connection point for connecting with the backrest linkage 106. The laterally extending flange 138 extends from a lower edge of the full-flat lift link 112 and within the plane of the full-flat lift link 112. In an embodiment, the flange 138 has a generally arcuate perimeter and forms a semicircular flange extending from the edge of the full-flat lift link 112 from at or near the forward end of the link 112 to a distance along the length of the link 112 at which point the perimeter of the flange 138 meets the body of the full-flat lift link 112 at an approximately right angle. The full-flat lift link 112 also includes a pivot point 140 at the forward end thereof for coupling to the pivot link 120.

The toggle link 114 is rotatably coupled at a first end to the seat support link 110 at the apex of the central arced section 128 thereof and at a second end to the ottoman connecting link 118. The toggle link 114 is further coupled to an actuator mechanism (not shown) at the coupling between the toggle link 114 and the seat support link 110. In an embodiment, the toggle link 114 is rigidly coupled to the actuator mechanism. The actuator mechanism is any mechanism for allowing a user to pivot the toggle link 114 about its coupling to the seat support link 110 in order to actuate the mechanism 100. The actuator mechanism might include a manually actuated lever or handle (not shown) that protrudes from the side panel 16, 18 of the rocker-recliner 10, a motorized mechanism, or a cable actuated mechanism that is actuated by a user depressing a push-button or pulling a lever, among other actuator mechanisms known in the art.

The main connecting link 116 is an elongated member having a slight bend near its midpoint. The main connecting link 116 is coupled to the backrest linkage 106 at a rear end and to the ottoman linkage 104 at a forward end. The main connecting link 116 also includes a cam pin 142 disposed proximate its forward end. The cam pin 142 extends perpendicularly from the surface of the main connecting link 116 a sufficient distance to interact with a cam surface 144 formed by the perimeter of the laterally extending flange 138 of the full-flat lift link 112.

The ottoman connecting link 118 is a generally curved member that is pivotally coupled at a rear end to the toggle link 114 and to the ottoman linkage 104 at a forward end. The pivot link 120 provides a pivoting connection between the full-flat lift link 112 and the base link 122. The base link 122 supports the seat support linkage 102 and the mechanism 100 generally through the pivot link 120 coupled to a forward end and the backrest linkage 106 coupled to the aft end thereof. The base link 122 is further mounted along its length to the rocker cam 124. The rocker cam 124 supports the mechanism 100 on the base 22 (not shown) and includes a lower surface having an arcuate form on which the rocker-recliner 10 can rock.

The ottoman linkage 104 is disposed near the forward end of the seat support linkage 102 and provides retraction and extension of the footrest 20. In an embodiment, the ottoman linkage 104 and an extendable footrest are not employed in a rocker-recliner configuration. The ottoman linkage 104 includes an ottoman drive link 146, an ottoman pivot link 148, a first ottoman support link 150, a second ottoman support link 152, a mid-ottoman support bracket 154, and a footrest bracket 156.

The ottoman drive link 146 is coupled at a first end thereof near the forward end of the seat support link 110 at a pivot point 158. The main connecting link 116 is pivotally connected to the ottoman drive link 146 at a pivot point 160 spaced apart from the pivot point 158. The ottoman drive link 146 is further coupled to the ottoman connecting link 118 at a pivot point 162 spaced still further from the pivot point 158. At a distal second end, the ottoman drive link 146 pivotally connects to the first ottoman support link 150.

The ottoman pivot link 148 pivotally couples at a first end thereof to the forward end of the seat support link 110 and further couples to both the first and second ottoman support links 150, 152 at a second end thereof. The first and second ottoman support links are rotatably connected to the ottoman drive link 146 and the ottoman pivot link 148 as described above and to the footrest bracket 156 at distal ends thereof. The mid-ottoman support bracket 154 is also rotatably connected to both the first and second ottoman support links 150, 152 and is generally centrally location along their lengths.

The backrest linkage 106 is generally disposed near the rear portion of the seat support linkage 102. The backrest linkage 106 includes a backrest support link 164 that has a generally V-shaped configuration. The backrest support link 164 is connected to the full-flat lift link 112 via the aperture 136 at a distal end of a lower leg 166 of the link 164. A pivot connection 167 is also provided near a midpoint of the lower leg 166 between the backrest support link 164 and the seat support link 110. An upper leg 168 of the link 164 provides one or more apertures 170 for attaching to the backrest portion 14 of the rocker-recliner 10. An additional pivot point is provided at the apex of the backrest support link 164 by a connection to a rear bracket 172.

The rear bracket 172 is a generally triangular-shaped member that has a rotatable connection at each of its three apexes: a first apex connected to the backrest support link 164, a second apex connected to the main connecting link 116, and a third apex connected to the base link 122.

The blocker linkage 108 provides a retractable blocker arm 174 that may be extended when the rocker-recliner 10 is moved from the upright position to a reclined position such that the rocker-recliner 10 is obstructed from rocking while in the reclined position. Such restriction from rocking is advantageous or desirable to avoid tipping of the rocker-recliner 10 when in the reclined position. Due to the changed location of the center of gravity of the rocker-recliner 10 and/or the occupant thereof when in the reclined position the rocker-recliner 10 may be at an increased likelihood for tipping and instability. In an embodiment, a blocker linkage 108 is not employed in the rocker-recliner 10.

The blocker linage 108 includes the blocker arm 174 and a blocker link 176. The blocker arm 174 is rotatably coupled at a first end to a bracket 178 mounted to the base link 122 and to the blocker link 176 at a point spaced slightly inward along the length of the blocker arm 174. A roller 176 or bumper is disposed at a second end of the blocker arm 174 to provide a contact surface with the base 22 or a floor surface on which the rocker-recliner 10 is placed. The blocker link 176 is coupled at an opposite end to the seat support link 110 at a point along the central arced section 130 thereof.

With continued reference to FIGS. 2-4, the operation of the mechanism 100 is described. Beginning initially from the upright position depicted in FIG. 2, the mechanism 100 is fully retracted. The backrest portion 14 is in a generally upright position and the footrest 20 is retracted into the front of the rocker-recliner 10. Additionally, the backrest portion 14 is locked in the upright position by the interaction of the cam pin 142 and the cam surface 144 of the full-flat lift link. In an embodiment, the insertion point of the laterally extending flange 138 into the body of the full-flat lift link 112 forms or acts as a slot or notch into which the cam pin 142 is received to further aid in locking the movements of the mechanism 100 when in the upright position. For example, when a force is applied to the backrest portion 22 or the backrest support link 164 as denoted by the arrow 182 in FIG. 2, such as by an occupant pressing rearward on the backrest portion 22, the backrest support link 164 is urged to rotate about its connection point 167 with the seat support link 110. Such rotational movement would require rotation of the full-flat lift link 112 about its pivot point 132 with the seat support link 110 however, the full-flat lift link 112 is prohibited from such rotation by the cam pin 142. An additional pin 184 may also be included to prohibit similar movement of the backrest support link 164 in a forward manner. In an embodiment, the footrest 20 is also locked in its retracted position by the interaction of the cam pin 142 and cam surface 144.

It is also noted that the blocker arm 174 is also in a retracted position tucked beneath the base link 122. As such, the rocker-recliner 10 is free to rock on the rocker cam 124.

To move the rocker-recliner 10 from the upright position to the reclined or TV position depicted by FIG. 3, a user or occupant actuates the actuator mechanism. For example, the occupant might pull a lever extending from the side panel 16, 18 of the rocker-recliner 10, depress a button in the side panel 16, 18, or pull a lever disposed in the side panel 16, 18 that manipulates a cable within the rocker-recliner 10. The actuator mechanism rotates the toggle link 114 from a position extending generally rearwardly from its connection with the seat support link 110 to a position extending generally forward of the connection. The rotation of the toggle link 114 may be assisted by one or more springs 186 connected to the toggle link 114 and to the seat support link 110, among other available connection locations and configurations.

The rotation of the toggle link 114 operates to manipulate the mechanism 100 to extend the footrest 20 and the blocker arm 174 (where such components are employed in the rocker-recliner 10). Rotation of the toggle link 114 moves the ottoman connecting link 118 forward and thereby rotates the ottoman drive link 146 about its pivot point 158 with the seat support link 110. Rotation of the ottoman drive link 146 extends the ottoman linkage 104 forward from the rocker-recliner 10 and draws the main connecting link 116 in a forward sweeping arc. By drawing the main connecting link 116 forward, the cam pin 142 translates along the cam surface 144 toward the forward end of the full-flat lift link 112, thereby freeing the backrest support link 164 to recline.

Additionally, in combination with drawing the main connecting link 116 forward the seat support link 110, and the mechanism 100 generally, shift slightly downward and rearward. Such motion causes the rear bracket 172 to rotate about its connection with the back support link 164. This rotation moves the connection point between the rear bracket 172 and the blocker arm 174 upward and forward thereby, causing the blocker arm 174 to rotate about its connection to the blocker link 176 and to move the roller 180 downward and rearward to an extended position.

In an embodiment, the movement of the mechanism 100 from the upright position to the reclined/TV position is assisted by the spring 186. In another embodiment, the movements are assisted by the occupant's weight applying a downward force on the seat support link 110.

In the reclined or TV position depicted in FIG. 3, the footrest 20 and the blocker arm 174 are extended. Additionally, the seat support link 110 and the seat portion 12 may be slightly inclined or more inclined than in the upright position of FIG. 2. The backrest portion 14 and the backrest support link 164 are at generally the same angle of incline as provided in the upright position. In an embodiment, the backrest portion 14 and the backrest support link 164 are more reclined in the reclined/TV position than in the upright position of FIG. 2. For example, in an embodiment the upper leg 168 of the backrest support link 164 is positioned at an approximately 65° angle with respect to the horizontal when in the upright position and at an approximately 58° angle with respect to the horizontal when in the reclined/TV position. It should be noted that the actual angle of the backrest portion 14 may vary from that of the backrest support link 164 based on the orientation at which the two components are fixed together.

From the reclined/TV position of FIG. 3, the rocker-recliner 10 is moved to the full-flat reclined position of FIG. 4 by an occupant applying a force on the backrest portion 14 as indicated by the arrow 188 in FIG. 3. The force 188 rotates the backrest support link 164 rearward about its connection point 167 with the seat support link 110. Such rotation also pivots the full-flat lift link 112 about its pivot 132 with the seat support link 110 and raises the rear end of the full-flat lift link 112. The coupling of the backrest support link 164 to the full-flat lift link 112 via the aperture 136 provides additional range of motion of the backrest support link 164 and thereby allows the backrest support link to rotate rearward a sufficient amount to provide a flat or nearly flat seating surface formed by the seat portion 12, backrest portion 14, and the footrest 20. In an embodiment, the backrest support link 164 is rotated to an approximately 22° or smaller angle with respect to the horizontal.

The rearward rotation of the backrest support link 164 further acts to raise the rear end of the seat support link 110. This also aids in generating the fully flat seating surface. In an embodiment, the additional rotational travel of the backrest support link 164 and the raising of the seat support link 110 provides an angle between the upper leg 168 of the backrest support link 164 and a top surface of the seat support link 110 of approximately about 158° or greater. As such, when assembled in the rocker-recliner 10 having the seat portion 12 and the backrest portion 14 affixed to the seat support link 110 and the backrest support link 164, respectively, a top surface of the seat portion 12 and the backrest portion 14 form a nearly 180° angle or lie in generally a single plane. Thus, a fully, or nearly fully flat seating surface is provided by the top surfaces of the seat portion 12 and the backrest portion 14. Additionally, in an embodiment, the footrest 20 is extended into the same, or nearly the same plane as the top surfaces of the seat portion 12 and the backrest portion 14 to further extend the fully flat, or nearly fully flat seating surface of the rocker-recliner 10 when in the full-flat recline position.

In an embodiment, the movements of the rocker-recliner 10 from the reclined/TV position to the full flat reclined position are aided by one or more springs 190 connected to the backrest support link 110 and the main connecting link 116, among other configurations.

In another embodiment, return of the mechanism to the reclined/TV position and to the upright position is provide by the reverse of the motions described above. Additionally, the return movement to the reclined/TV position may be initiated by applying a downward force to the seat support link 110 and/or reducing a rearward and downward force applied to the backrest portion 14 and thus the backrest support link 164. Return of the rocker-recliner from the reclined/TV position to the upright position may be initiated by applying a downward force to the footrest 20 followed by a rearward force to retract the footrest 20 into the rocker-recliner 10 and to reset the toggle link 114 to its original position. In another embodiment, one or more drive mechanisms, such as an electric motor are utilized to apply the required forces for moving the rocker-recliner between positions.

Many different arrangements of the various components depicted, as well as components not shown, are possible without departing from the scope of the claims below. Embodiments of the technology have been described with the intent to be illustrative rather than restrictive. Alternative embodiments will become apparent to readers of this disclosure after and because of reading it. Alternative means of implementing the aforementioned can be completed without departing from the scope of the claims below. Certain features and subcombinations are of utility and may be employed without reference to other features and subcombinations and are contemplated within the scope of the claims.

The invention claimed is:

1. A linkage for use in reclining furniture comprising:

a seat support linkage that includes a seat support link, a connecting link having a cam pin disposed proximate a forward end, and a full-flat lift link rotatably coupled to the seat support link at a pivot point located between a first end and a second end of the full-flat lift link, the first end including a laterally extending flange that provides a cam surface for engaging the cam pin and the second end including an elongated aperture for coupling to a backrest support link; and a backrest linkage including the backrest support link coupled to the second end of the full-flat lift link, wherein the pivot point of the full-flat lift link is positioned such that rearward rotation of the backrest linkage causes the second end of the full-flat link to rotate upward and a rearward portion of the seat support link to rotate upward.

2. The linkage of claim 1, wherein an angle formed between the seat support link and the backrest support link is greater than about 158° when the backrest support link is rotated rearwardly.

3. The linkage of claim 1, wherein an angle formed between the seat support link and the backrest support link is about 180° when the backrest support link is rotated rearwardly.

4. The linkage of claim 1, wherein the laterally extending flange of the full-flat lift link includes a generally arcuate perimeter and intersects a body of the full-flat lift link at an approximately right angle, wherein the cam pin rests at an intersection of the flange and the body when the linkage is closed, and wherein the cam pin translates along the arcuate perimeter of the flange when the linkage moves from a closed position to a reclined position.

5. The linkage of claim 4, wherein the interaction of the cam pin and the full-flat lift link restricts an extension of an ottoman linkage when the linkage is in a closed.

6. The linkage of claim 1, further comprising, a blocker linkage coupled to the seat support linkage and the backrest linkage.

7. The linkage of claim 1 further comprising an ottoman linkage pivotally coupled to the seat support linkage.

8. The linkage of claim 7, wherein the linkage is configurable to three positions that include a collapsed position in which the ottoman linkage is retracted, a reclined position in which the ottoman linkage is extended, and a full-flat reclined position in which the backrest support link is rotated rearwardly and the ottoman linkage is extended.

9. The linkage of claim 1, wherein the rearward rotation of the backrest support link causes at least a portion of the seat support link to be raised.

10. The linkage of claim 1, wherein the rearward rotation of the backrest support link is aided by one or more springs coupled to the linkage.

11. A three-position reclining seating unit configurable to a full-flat recline position via a linkage disposed therein, the linkage comprising:

a seat support linkage that includes a seat support link, a connecting link having a cam pin disposed proximate a forward end, and a full-flat lift link rotatably coupled to the seat support link at a pivot point located between a first end and a second end of the full-flat lift link, the first end including a laterally extending flange that provides a cam surface for engaging the cam pin and the second end including an elongated aperture for coupling to a backrest support link;

an ottoman linkage pivotally coupled to the seat support linkage that extends a footrest from a front portion of the seating unit when the seating unit is moved from an upright position;

a backrest linkage including the backrest support link coupled to the second end of the full-flat lift link;

a seat portion at least partially supported by the seat support link; and a backrest portion at least partially supported by the backrest support link, wherein the pivot point of the full-flat lift link is positioned such that rearward rotation of the backrest linkage causes the first end of the full-flat link to rotate downward and a rearward portion of the seat support link to rotate upward.

12. The seating unit of claim 11, wherein the laterally extending flange of the full-flat lift link includes a generally arcuate perimeter and intersects a body of the full-flat lift link at an approximately right angle, wherein the cam pin rests at an intersection of the flange and the body when the chair is in an upright position, and wherein the cam pin translates along the arcuate perimeter of the flange when the chair moves from the upright position to a reclining position.

13. The seating unit of claim 12, wherein the interaction of the cam pin and the full-flat lift link restricts an extension of the ottoman linkage when the article of furniture is in the upright position.

14. The seating unit of claim 11, further comprising:

a blocker linkage coupled to the seat support linkage and the backrest linkage, the blocker linkage including a blocker arm that is pivoted downwardly from a lower portion of linkage to restrict rocking motion of the seating unit when the seating unit is moved from an upright position to a reclined position.

15. A linkage for use in a seating unit, the linkage comprising:

a seat support link having a forward linear section and a rearward linear section;

a full-flat lift link rotatably coupled to the seat support link at a pivot point located between a first end and a second end of the full-flat lift link, the second end including an elongated aperture;

a connecting link having a cam pin disposed proximate a forward end, wherein the first end of the full-flat lift link includes a laterally extending flange that provides a cam surface for engaging the cam pin; and a backrest support link coupled to the second end of the full-flat lift link via the elongated aperture and to the rearward linear section of the seat support link.

16. The linkage of claim 15, further comprising:

an ottoman linkage pivotally coupled to the seat support link that extends a footrest from a first position to a second position.

17. The linkage of claim 15, wherein the laterally extending flange of the full-flat lift link includes a generally arcuate perimeter and intersects a body of the full-flat lift link at an approximately right angle, wherein the cam pin rests at an intersection of the flange and the body when the chair is in an upright position, and wherein the cam pin translates along the arcuate perimeter of the flange when the chair moves from the upright position to a reclining position.

18. The linkage of claim 17, wherein an interaction of the cam pin and the full-flat lift link restricts an extension of the ottoman linkage when the linkage is in a closed position.

19. The linkage of claim 17, wherein one or more springs coupled to the linkage assist actuation of the linkage to translate the cam pin along the cam surface.

* * * * *